US006452474B1

(12) United States Patent
Oh

(10) Patent No.: US 6,452,474 B1
(45) Date of Patent: Sep. 17, 2002

(54) BARRIER FUSE

(75) Inventor: Seibang Oh, Elk Grove Village, IL (US)

(73) Assignee: Littelfuse, Inc., Des Plaines, IL (US)

( * ) Notice: Subject to any disclaimer, the term of this patent is extended or adjusted under 35 U.S.C. 154(b) by 0 days.

(21) Appl. No.: 09/694,188

(22) Filed: Oct. 23, 2000

Related U.S. Application Data

(63) Continuation of application No. 09/516,574, filed on Mar. 1, 2000.

(60) Provisional application No. 60/123,078, filed on Mar. 4, 1999.

(51) Int. Cl.[7] ..... H01H 85/38; H01H 85/175

(52) U.S. Cl. ..... 337/278; 337/273; 337/282; 337/186

(58) Field of Search ..... 337/186, 260, 337/273, 274, 275, 282, 290, 295, 278; 29/623

(56) References Cited

U.S. PATENT DOCUMENTS

| | | | | | |
|---|---|---|---|---|---|
| 480,802 | A | * | 8/1892 | Blathy | 337/278 |
| 1,700,582 | A | * | 1/1929 | Brown | 337/216 |
| 2,245,346 | A | * | 6/1941 | Klein | 200/131 |
| 2,794,097 | A | * | 5/1957 | Jacobs, Jr. | 337/278 |
| 3,775,723 | A | * | 11/1973 | Mamrick et al. | 337/245 |
| 3,909,767 | A | | 9/1975 | Williamson et al. | |
| 4,023,265 | A | | 5/1977 | Aryamane | |
| 4,131,869 | A | | 12/1978 | Schmidt, Jr. et al. | |
| 4,570,147 | A | * | 2/1986 | Ebi | 337/166 |
| 4,580,124 | A | | 4/1986 | Borzoni | |
| 4,604,602 | A | | 8/1986 | Borzoni | |
| 4,608,548 | A | * | 8/1986 | Borzoni | 337/201 |
| 4,635,023 | A | | 1/1987 | Oh | |
| 4,646,053 | A | * | 2/1987 | Mosesian | 337/232 |
| 4,661,793 | A | | 4/1987 | Borzoni | |
| 4,672,352 | A | * | 6/1987 | Takano | 337/264 |
| 4,703,299 | A | * | 10/1987 | Vermij | 337/158 |
| 4,869,972 | A | * | 9/1989 | Hatagishi | 428/647 |
| 4,871,990 | A | * | 10/1989 | Ikeda et al. | 337/238 |
| 4,894,633 | A | | 1/1990 | Holtfreter | |
| 4,997,393 | A | | 3/1991 | Armando | |
| 5,101,187 | A | * | 3/1992 | Yuza | 337/278 |
| 5,130,688 | A | * | 7/1992 | Van Rietschoten et al. | 337/231 |
| 5,139,443 | A | | 8/1992 | Armando | |
| 5,153,553 | A | * | 10/1992 | Ruehl et al. | 337/273 |
| 5,581,225 | A | * | 12/1996 | Oh et al. | 337/295 |
| 5,631,620 | A | * | 5/1997 | Totsuka et al. | 337/260 |
| 5,663,861 | A | | 9/1997 | Reddy et al. | |
| 5,668,521 | A | | 9/1997 | Oh | |

FOREIGN PATENT DOCUMENTS

| | | | | |
|---|---|---|---|---|
| DE | 27 14 797 A1 | | 2/1979 | |
| EP | 0 285 489 A1 | | 10/1988 | |
| EP | 0 802 553 A2 | | 10/1997 | |
| EP | 0 939 417 A1 | | 9/1999 | |
| GB | 2 113 489 A | | 8/1983 | |
| GB | 2 233 512 A | | 1/1991 | |
| JP | 8-162000 A | * | 6/1996 | H01H/85/175 |
| JP | 10-241546 A | * | 9/1998 | H01H/85/18 |

* cited by examiner

*Primary Examiner*—Anatoly Vortman
(74) *Attorney, Agent, or Firm*—Bell, Boyd & Lloyd LLC

(57) ABSTRACT

The invention is a housing for a blade fuse, and a blade fuse that uses that housing. The housing includes a first generally planar wall and a second generally planar wall. The first and the second generally planar walls each have an outer surface and an inner surface, and the inner surface of the first generally planar wall faces the inner surface of the second generally planar wall. Each of the generally planar walls has at least one rib extending from its inner surfaces. The one or more rib on the inner surface of the first generally planar wall extends towards, and is generally aligned with, the one or more corresponding rib on the inner surface of the second generally planar wall. These generally aligned rib sets form a gap, and the gap is sized so as to permit the close-fitting insertion of a fuse element between that gap.

19 Claims, 2 Drawing Sheets

BARRIER FUSE

CROSS-REFERENCE TO RELATED APPLICATION

This application claims the benefit of U.S. Provisional Application No. 60/123,078, filed on Mar. 4, 1999; and is a continuation application from U.S. application Ser. No. 09/516,574, filed Mar. 1, 2000.

DESCRIPTION

Technical Field

This invention relates generally to electrical blade fuses, and to housings for use in blade fuses, for either high or low voltage applications.

BACKGROUND OF THE INVENTION

Electrical blade fuses are well-known in the art. The modern electrical blade fuse was perfected by Littelfuse, Inc., the assignee of the present invention, and was described in many patents owned by the assignee. These patents include, but are not limited to, Littelfuse's U.S. Pat. Nos. 3,909,767; 4,023,365; 4,131,869; 4,580,124; 4,604,602; 4,635,023; 4,661,793; 4,997,393; 5,139,443; 5,663,861; and 5,668,521.

Some of fuses described in these patents include either a V-shaped or a sinusoidal-shaped fuse link. One example of such a V-shaped fuse link is that shown in U.S. Pat. No. 4,131,869. The V-shaped fuse link is shown as item 20 in FIG. 13 of the '869 patent, and is described at column 6, line 56, through column 7, line 18 of the '869 patent.

As is well-known in the art, blade fuses of the types shown in the above-referenced patents protect electrical circuits from current overloads. This protection results from the creation of a short in the fuse, and therefore in the circuit protected by the fuse, upon certain current overload conditions. Particularly, the fuse link breaks or opens upon current overload during a predetermined length of time.

Many of these blade fuses are extensively used in automobiles, and are therefore designed to be rated for service up to 32 volts. Now, however, automobile manufacturers are designing more electrical accessories into automobiles, and are also designing or contemplating vehicles that use electrical motors, rather than internal combustion engines, for propulsion. Both of these developments increase the electrical demands upon current and future vehicles. As a result, circuits rated at 60 volts and higher are now being contemplated for automobiles.

When the fusible link opens in fuses like those of the '869 patent, especially those rated at up to 32 volts, an arc forms between the melted ends of the fusible link. At these lower voltages, the arc will not cause serious damage to the metal and plastic portions of the fuse. Even at these lower voltages, however, an arc can cause some discoloration or disfiguration of the fuse components. At higher voltages, moreover, significantly more extensive damage to the metal and plastic portions of the fuse can occur.

SUMMARY OF THE INVENTION

The invention is a housing for a blade fuse. The housing includes a first generally planar wall and a second generally planar wall. Each of these two planar walls has an outer surface and an inner surface. The inner surface of the first generally planar wall faces the inner surface of the second generally planar wall.

Each of the generally planar walls have a pair of ribs extending from those inner surfaces. The ribs act as arc barriers. The two ribs on the inner surface of the first generally planar wall extend towards, and are generally aligned with, the two ribs on the inner surface of the second generally planar wall. While the ribs on the inner surfaces of the first and second generally planar walls extend towards each other, they do not touch, but instead form a gap. The gap is sized so as to permit the insertion of a fuse element that is a component of the completed blade fuse. Preferably, this gap is sized so that upon manual or automated insertion of the fuse element, no portion of its fusible link will contact any of the adjacent ribs. Such contact could cause distortion of the fusible link, and such distortion could damage the assembled fuse.

One aspect of the invention is a blade fuse where the ribs are integrally formed with the blade fuse housing.

In yet another aspect of the invention, the ribs have a height in excess of one-half of the height of the blade fuse housing.

Another aspect of the invention is a blade fuse, combining a metallic, fuse element, and the housing of the invention. The blade fuse and the blade fuse housing of the present invention are suitable for use in a circuit having a voltage rating of sixty volts and higher.

DETAILED DESCRIPTION

This invention is susceptible of many different forms or embodiments. The drawings and the specification describe in detail a preferred embodiment of the invention. This disclosure is to be considered as one example of the principles of the invention. This disclosure is not intended to limit the broad aspect of the invention to the illustrated embodiments.

First Embodiment of the Invention

The first embodiment of the invention is depicted in FIGS. 1–8. The invention is a housing 10 for a blade fuse 12, or that blade fuse 12 itself. The housing 10 of the invention can be made of any of different materials, including nylon. The type of nylon used is not critical to the invention. However, a preferred nylon for the invention is a ZYTEL® translucent nylon resin. A most preferred nylon resin is ZYTEL®FE5456 NC010 translucent nylon resin. The ZYTEL® line of translucent nylon resins is available from E.I. duPont de Nemours & Co., Engineering Polymers, Wilmington, Del. 19898. The nylon used should be a colorable, translucent nylon resin suitable for injection molding applications, especially where there is a need to see through the moldings. While this type of nylon resin is preferred, a transparent or opaque nylon having a sufficiently high melting temperature will also be suitable for the housings of the invention. One example of a resin that can also be used for the housings 10 of the invention is RYNITE® polyethylene terephthalate (PET) thermoplastic polyester resin, which is also a product of E.I. dupont de Nemours & Co., Engineering Polymers, Wilmington, Del. 19898.

Figure 1:
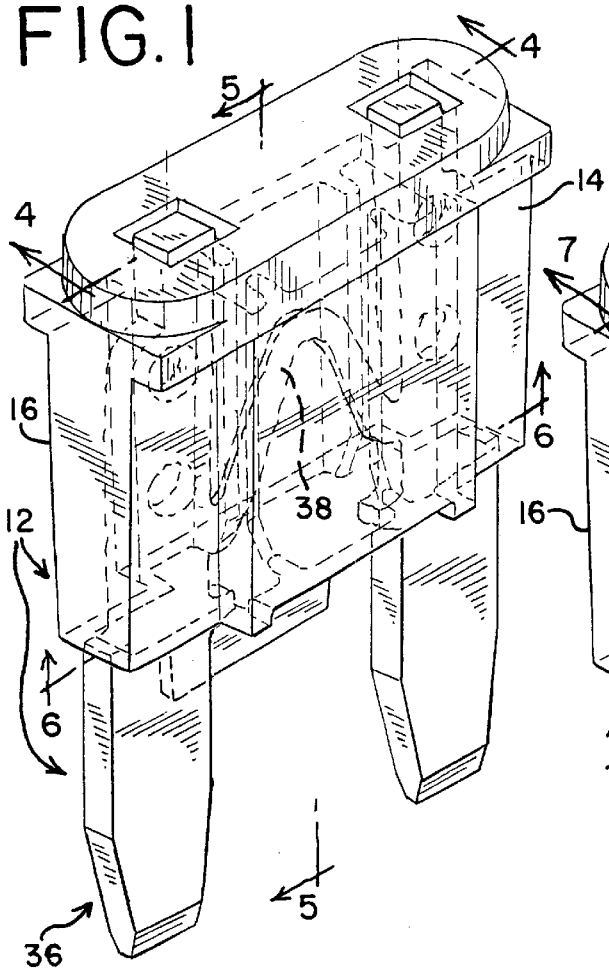
FIG. 1 is a perspective, assembled view of a preferred embodiment of a preferred blade fuse utilizing the housing of the invention.
Figure 2:
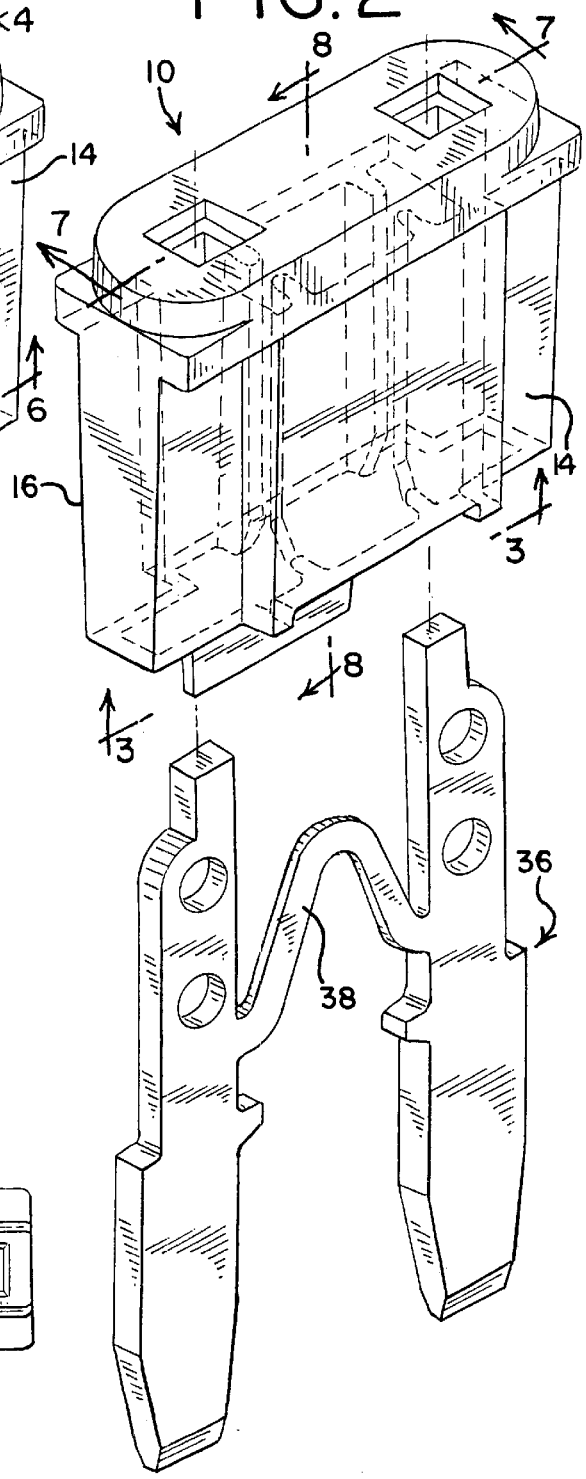
FIG. 2 is a perspective, exploded view of the blade fuse of FIG. 1, showing a one-piece, metal fuse element portion.
Figure 3:
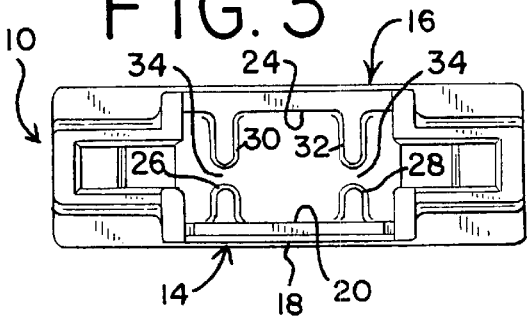
FIG. 3 is a bottom view of the housing of FIG. 2, taken along lines 3—3 of FIG. 2.

As may best be seen in FIGS. 1–3, each housing 10 has a first generally planar wall 14 and a second generally planar wall 16. In the preferred embodiment, these planar walls 14 and 16 are substantially parallel to each other. As may best be seen in FIG. 3, first generally planar wall 14 has an outer surface 18 and an inner surface 20. Similarly, as may also be seen in FIG. 3, second generally planar wall 16 includes its own outer surface 22 and inner surface 24.

As may be seen in FIG. 3, the inner surface 20 of the first generally planar wall 14 faces the inner surface 24 of the second generally planar wall 16. Inner surface 20 of the first generally planar wall 14 has two ribs, a first rib 26 and a second rib 28, extending from that surface. Inner surface 24 of the second generally planar wall 16 has two ribs, a first rib 30 and a second rib 32, extending from that surface 24. While this preferred embodiment shows two ribs on each generally planar wall, it should be understood that each generally planar wall may instead have only one rib.

The first rib 26 on the inner surface 20 of the first generally planar wall 14 extends towards the first rib 30 on the inner surface 24 of the second generally planar wall 16. In addition, the second rib 28 on the inner surface 20 of the first generally planar wall 14 extends towards the second rib 32 on the inner surface 24 of the second generally planar wall 16. As may be seen in FIG. 3, the ribs 30 and 32 are somewhat longer than the ribs 26 and 28. Preferably, the ribs 26, 28, 30, and 32 of the housing 10 are integrally formed with that housing 10.

While the rib set 26 and 30 and the rib set 28 and 32 extend towards each other, they do not touch each other at their tips. Thus, as may be seen from the preferred embodiment of FIG. 3, a gap 34 is formed in the space that passes between rib set 26 and 30 and rib set 28 and 32. This gap 34 is where the fusible link 38 of the fuse element 36 is to be positioned. Because ribs 30 and 32 are somewhat longer than the ribs 26 and 28, this gap 34 will be somewhat offset from the center of the fuse housing 10. As is well-known in the art, the fusible link 38 is generally thinner than the remaining one-piece fuse element 36. The thinning of this fusible link 38 is effected by a skiving or similar process that is well known in the art. The structure of the present invention, with its offset gap 34, helps to accommodate this one-piece fuse element 36 having the skived fusible link 38.

It will, however, be understood by those skilled in the art that the invention need not have an offset gap, but can instead have a gap that is centered within the blade fuse housing 10. A centered gap would be created if the ribs on the two respective generally planar walls were of the same length, rather than of a different length.

This gap 34 is sized so as to permit the insertion of the fuse element 36 and its fusible link 38 between that gap 34. Particularly, the gap 34 is sufficiently large so that the fuse element 36 may be automatically or manually inserted into the fuse housing 10 without the any part of the fusible link 38 touching the ribs 26, 28, 30, and 32.

Figure 4:
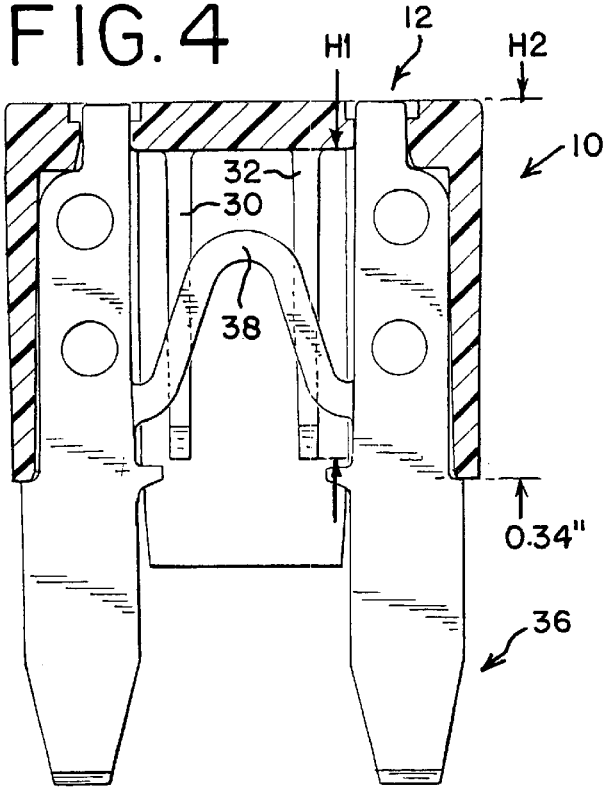
FIG. 4 is a cross-sectional view of the blade fuse of FIG. 1, taken along lines 4—4 of FIG. 1.
Figure 5:
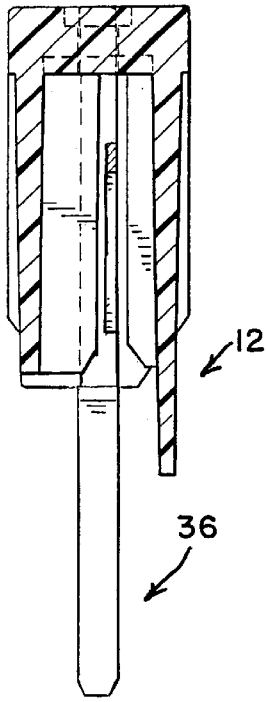
FIG. 5 is a side, sectional view of the blade fuse and housing of FIG. 1, taken along lines 5—5 of FIG. 1.
Figure 6:
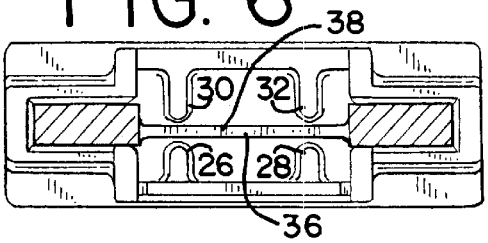
FIG. 6 is a bottom view of the housing of FIG. 1, taken along lines 6—6 of FIG. 1.
Figure 7:
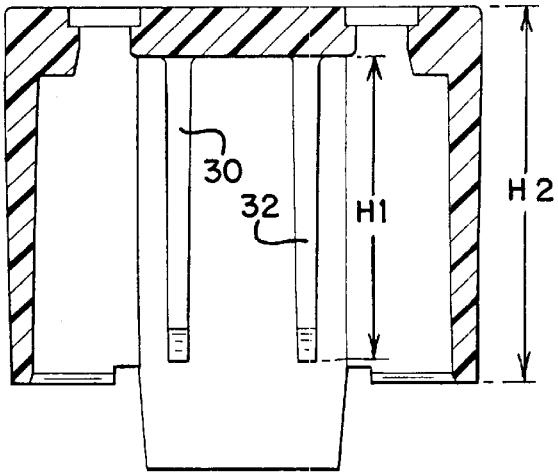
FIG. 7 is a side, sectional view of the blade fuse housing of FIGS. 1 and 2, taken along lines 7—7 of FIG. 2.
Figure 8:
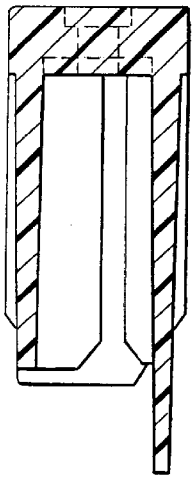
FIG. 8 is a side, sectional view of the blade fuse housing of FIG. 2, taken along lines 8—8 of FIG. 2.

The height of the ribs may best be seen in FIG. 4 and 7. The height H1 of these ribs preferably exceeds one-half of the height H2 of the fuse housing 10. In one preferred embodiment of the invention, the height H1 of the ribs 30 and 32 is approximately 0.275 inch, while the height H2 of the housing 10 is approximately 0.34 inch.

Second Embodiment of the Invention

Figure 9:
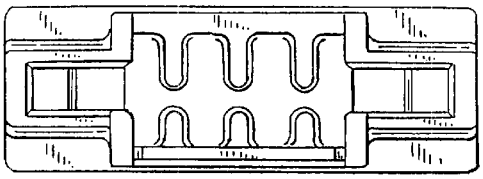
FIG. 9 is a second embodiment of the present invention, with three ribs on each of the planar walls, rather than the two ribs shown in the embodiment of FIGS. 1–8.

A second embodiment of the invention is shown in FIG. 9. This second embodiment is virtually identical to the embodiment shown in FIGS. 1–8, with one notable exception. As may be seen in that FIGURE, the embodiment of FIG. 9 includes three sets of ribs on each of the housing inner walls, rather than two sets of ribs.

It shall be understood by those skilled in the art that the invention can include more than three sets of ribs on each of the inner walls, as well.

Results of Testing of the First and Second Embodiments

The ribs of the first and second embodiments act as arc barriers. To establish the extent to which these two embodiments are successful as arc barriers, fuse housings in accordance with the invention, i.e., having two and three rib sets, were compared to fuse housings otherwise identical, but without any rib sets.

A simulated arc was formed within one of three blade fuses. Each of the three blade fuses had different blade fuse housings, and each of the three blade fuse housings were made of an identical nylon material. The control housing lacked any of the rib sets of the present invention. The second of the three housings included two rib sets, like the housing shown in FIGS. 1–8. The third of the three housings included three rib sets, like the housing shown in FIG. 9.

In a test circuit, arcs were created within each of the blade fuse housings. As the arc was created, the arcing energy (also known as "$I^2T$") within each of the three housings was measured.

In the housing without ribs, the $I^2T$ energy averaged 746.0 $amp^2$ seconds. In the housing having two rib sets, the $I^2T$ energy averaged 334.4 $amp^2$ seconds. In the housing having three rib sets, the $I^2T$ energy averaged 316.6 $amp^2$ seconds.

Accordingly, when compared to the housing without rib sets, the housing having two ribs sets reduced the $I^2T$ energy by 55.2%. When compared to the housing without rib sets, the housing having three ribs sets reduced the $I^2T$ energy by 57.6%. This reduction in $I^2T$ energy is significant, in that the reduction in such energy lowers the probability of cosmetic or structural damage to the fuse and its housing during arcing conditions.

It has also been discovered that, all other things being equal, providing as narrow as possible of a gap 34 results in a reduction in the $I^2T$ energy emitted during arcing conditions. In the preferred embodiment of FIGS. 1–8, the gap 34 between the rib sets is approximately 0.02 inch, while the thickness of the fusible link 38 adjacent those ribs is approximately 0.004–0.010 inch.

While the specific embodiments have been illustrated and described, numerous modifications come to mind without significantly departing from the spirit of the invention. Thus, the scope of protection is to be limited only by the scope of the accompanying Claims.

I claim:

1. A housing for a blade fuse, said housing comprising a first generally planar wall and a second generally planar wall; each of said first and second generally planar walls having an outer surface and an inner surface, respectively;

the inner surface of said first generally planar wall facing the inner surface of said second generally planar wall; each of said generally planar walls having at least two ribs extending from those inner surfaces, said at least two ribs on the inner surface of the first generally planar wall extending towards, and being coplanar with, said at least two ribs on said inner surface of said second generally planar wall, said coplanar ribs not contacting each other and forming a gap, said gap being sized so as to permit the insertion of a fuse element in the gap.

2. The housing for a blade fuse as set forth in claim 1, wherein said gap is sized such that upon manual or automated insertion of a fuse element between said ribs, said fuse element will not contact any of said ribs.

3. The housing for a blade fuse as set forth in claim 1, where said ribs are integrally formed with the blade fuse housing.

4. The housing for a blade fuse as set forth in claim 1, wherein said ribs have a height in excess of one-half of the height of the blade fuse housing.

5. The housing for a blade fuse as set forth in claim 1, wherein the housing is plastic.

6. A blade fuse, comprising a housing for said blade fuse, said housing comprising a first generally planar wall and a second generally planar wall; each of said first and second generally planar walls having an outer surface and an inner surface, respectively; the inner surface of said first generally planar wall facing the inner surface of said second generally planar wall; each of said generally planar walls having at least two ribs extending from those inner surfaces, said at least two ribs on the inner surface of the first generally planar wall extending towards, and being coplanar with, said at least two ribs on said inner surface of said second generally planar wall, said coplanar ribs not contacting each other and forming a gap, said gap being sized so as to permit the insertion of a fuse element in the gap, said blade fuse further comprising a metallic element.

7. The blade fuse set forth in claim 6, wherein said gap is sized such that upon manual or automated insertion of a fuse element between said ribs, said fuse element will not contact any of said ribs.

8. The blade fuse set forth in claim 6, wherein said ribs are integrally formed with the blade fuse housing.

9. The blade fuse set forth in claim 6, wherein said ribs have a height in excess of one-half of the height of the blade fuse housing.

10. The blade fuse set forth in claim 6, wherein the ribs on the first generally planar wall have a different length than the ribs on the second generally planar wall.

11. The blade fuse set forth in claim 6, wherein the ribs on the first generally planar wall have the same length as the ribs on the second generally planar wall.

12. The blade fuse set forth in claim 6, wherein the housing is plastic.

13. A housing for a blade fuse, said housing comprising a first generally planar wall and a second generally planar wall; each of said first and second generally planar walls having an outer surface and an inner surface, respectively; the inner surface of said first generally planar wall facing the inner surface of said second generally planar wall; each of said generally planar walls having at least one rib extending from those inner surfaces, said at least one rib on the inner surface of the first generally planar wall extending towards, and being coplanar with, said at least one rib on said inner surface of said second generally planar wall, said coplanar ribs not contacting each other and forming a gap, said gap being sized so as to permit the insertion of a fuse element in the gap.

14. The housing for a blade fuse as set forth in claim 13, wherein said gap is sized such that upon manual or automated insertion of a fuse element between said ribs, said fuse element will not contact any of said ribs.

15. The housing for a blade fuse as set forth in claim 13, where said ribs are integrally formed with the blade fuse housing.

16. The housing for a blade fuse as set forth in claim 13, wherein said ribs have a height in excess of one-half of the height of the blade fuse housing.

17. The housing for a blade fuse as set forth in claim 13, wherein said rib on said first generally planar wall has a different length than the rib on said second generally planar wall.

18. The housing for a blade fuse as set forth in claim 13, wherein said rib on said first generally planar wall has the same length as the rib on said second generally planar wall.

19. The housing for a blade fuse as set forth in claim 13, wherein the housing is plastic.

* * * * *